US006718598B2

(12) United States Patent
Gorman et al.

(10) Patent No.: US 6,718,598 B2
(45) Date of Patent: Apr. 13, 2004

(54) PLASTIC CLIP CONSTRUCTION

(75) Inventors: Gregory P. Gorman, Clayton, NC (US); James S. Smith, Apex, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/266,004

(22) Filed: Oct. 7, 2002

(65) Prior Publication Data

US 2003/0226244 A1 Dec. 11, 2003

Related U.S. Application Data

(63) Continuation-in-part of application No. 10/164,439, filed on Jun. 6, 2002.

(51) Int. Cl.[7] ..... B65D 77/10; F16B 15/00

(52) U.S. Cl. ..... 24/30.5 W; 24/30.5 P; 403/393; 292/320; 292/325

(58) Field of Search ..... 24/30.5 W, 30.5 P, 24/30.5 R, 17 AP, 17 B, 115 H, 130, 33 L, 703.1; 292/328, 320, 307 B, 325

(56) References Cited

U.S. PATENT DOCUMENTS

| | | | | | |
|---|---|---|---|---|---|
| 56,894 | A | | 8/1866 | Brown | |
| 62,241 | A | | 2/1867 | Wells | |
| 96,459 | A | | 11/1869 | Meloy | |
| 113,834 | A | | 4/1871 | Balch et al. | |
| 182,771 | A | | 10/1876 | Palmberg | |
| 712,765 | A | | 11/1902 | Cole | |
| 1,069,512 | A | | 8/1913 | Adolphson | |
| 1,785,522 | A | * | 12/1930 | Matthes | 24/703 X |
| 1,911,060 | A | | 5/1933 | Clark | |
| 2,462,957 | A | | 3/1949 | Gunn | |
| 2,880,419 | A | | 4/1959 | Tipper | |
| 2,904,294 | A | * | 9/1959 | Marygold | 24/16 PB X |
| 2,986,787 | A | * | 6/1961 | Ackerman | 24/28 |
| 3,152,350 | A | | 10/1964 | Vosbikian | |
| 3,184,817 | A | * | 5/1965 | Chesnais | 403/393 |
| 3,400,433 | A | | 9/1968 | Klenz | |
| 3,530,544 | A | * | 9/1970 | Burniston | 24/16 R |
| 3,543,378 | A | | 12/1970 | Klenz | |
| 3,583,053 | A | | 6/1971 | Hein | |
| 3,591,223 | A | | 7/1971 | Neto | |
| 3,721,750 | A | | 3/1973 | Countryman | |
| 3,744,096 | A | * | 7/1973 | Kok | 24/16 PB |
| 3,747,164 | A | * | 7/1973 | Fortsch | 24/16 PB |
| 3,952,376 | A | * | 4/1976 | Ellis | 24/115 A |
| 4,128,922 | A | | 12/1978 | Hutchison | |
| 4,275,485 | A | | 6/1981 | Hutchison | |
| 4,370,778 | A | | 2/1983 | Madsen | |
| 4,379,536 | A | | 4/1983 | Mizuno et al. | |
| 4,528,898 | A | | 7/1985 | Sharp et al. | |
| 4,557,023 | A | | 12/1985 | Six et al. | |
| 4,675,945 | A | | 6/1987 | Evans et al. | |
| 4,817,901 | A | | 4/1989 | Kuo | |
| 4,878,702 | A | | 11/1989 | Madsen et al. | |
| 4,944,172 | A | | 7/1990 | Evans | |
| 5,286,110 | A | * | 2/1994 | Benson et al. | 24/30.5 R X |
| 5,544,391 | A | | 8/1996 | Hoffman | |
| 5,649,927 | A | * | 7/1997 | Kilpela et al. | |
| RE36,544 | E | | 2/2000 | Madsen | |
| 6,070,304 | A | | 6/2000 | Lii | |

* cited by examiner

*Primary Examiner*—Robert J. Sandy
(74) *Attorney, Agent, or Firm*—Banner & Witcoff, Ltd.

(57) ABSTRACT

A two-part clip construction includes a U-shaped clip made from a plastic material with the legs of the clip spaced so as to fit over and then be deformed through a through passage in a leg locking member. The construction is especially designed to permit utilization of polymerics for forming the clips.

68 Claims, 5 Drawing Sheets

PLASTIC CLIP CONSTRUCTION

CROSS REFERENCE TO RELATED APPLICATION

This application is a continuation-in-part of Ser. No. 10/164,439 filed Jun. 6, 2002 entitled "Plastic Clip Construction" which is incorporated herewith by reference and for which priority is claimed.

BACKGROUND OF THE INVENTION

In a principal aspect the present invention relates to a clip construction for closure of packaging material and, more particularly, to a two-part clip construction wherein the components are preferably comprised of a polymeric material.

The use of metal and plastic clips that function as closures for bags and containers is well known. Many types of clips and/or straps are utilized to wrap or close the end of a bag or container. For example, metal clips may be formed about gathered bagging material as taught in U.S. Pat. No. 2,880,419 as well as U.S. Pat. No. 3,400,433. These patents, as well as U.S. Pat. No. 4,944,172 disclose generally U-shaped metal clips which are formed about gathered packing material by clip attachment machines. U.S. Pat. No. 4,528,898 is another patent showing a similar clip, as is U.S. Pat. No. 3,400,433. Various apparatus are used for attaching such clips about gathered casing material including apparatus as disclosed in U.S. Pat. Nos. 2,880,419 and 3,543,378 as well as U.S. Pat. Nos. 3,583,053 and 4,675,945.

Metal clips work quite well for closing and sealing gathered packaging material. However, the use of metal as a clip material has certain attributes which may not be desired. Thus, there has developed a series of products made from plastic or polymeric materials having that function as a closure. For example, Reissue U.S. Pat. No. 36,544 discloses a method and apparatus as well as a construction which employs a polymeric clip material comprised of a U-shaped clip member and a second gathering lock member which cooperates with the U-shaped member to hold a gathered neck of flexible packaging material in the closed condition. U.S. Pat. No. 4,275,485 discloses yet another construction comprised of a single hinged clamp or sealing device for holding gathered packaging materials closed. Similarly, U.S. Pat. No. 4,128,922 shows a two-part sealing device or clamp for closure of the neck of a bag material which has been gathered.

There are numerous additional examples of both metal and plastic polymeric clip constructions comprised of a single piece or member or more than one member. Nonetheless, there has remained a desire and need for an improved plastic clip construction.

SUMMARY OF THE INVENTION

Briefly, the present invention comprises a two-part clip construction including a first U-shaped clip member generally in the form of a staple having a crown which connects first and second spaced legs. The legs of each clip member are spaced a first uniform distance, and the ends of the legs are generally coterminous. A second element of the construction comprises a sealing block that includes a through passage between the opposite sides of the block. The opposite sides of the sealing block are spaced a lesser distance than the spacing of the clip member legs. The clip member legs are thus designed to fit over the opposite sides of the block and then be deformed or driven toward one another into the through passage that joins the opposite sides of the sealing block. The legs thus bend or plastically deform, extend into the through passage from opposite sides of the sealing block and are forced through the through passage from opposite sides of the sealing block. The legs are retained in their deformed condition by the interactive friction thereof with the through passage in the block. The legs are effectively locked to the sealing block even though the surfaces of the legs and through passage may be generally smooth, though one or both clip construction elements may be textured.

The sides of the block member through which the through passage is defined are, in the preferred embodiment, more closely spaced one from the other than the terminal ends of the legs of the U-shaped clip member. This enables the ends of the U-shaped clip member to fit over the opposite sides of the block, to then be deformed and pass through the through passage from the opposite sides of the sealing block.

In a preferred embodiment, a single through passage is utilized to engage, guide and maintain the leg ends in the appropriate position overlapping one another and side by side. However, the number of and cross sectional configuration of through passages is not considered to be a limiting feature of the invention. The sealing block itself, as well as the U-shaped clip, are preferably a polymeric material; however, other materials, including metal materials, may be used, in particular, for the clip. Nonetheless, the clip is preferably a polymeric material and may comprise a uniform cross section rod or a variable shaped cross section rod element. Again, the material may also be varied. Importantly, the material is generally plastic and deformable (i.e. plastic) and thus may be subjected to strain which forces the ends of the clip legs through the through passage of the block member.

The clip construction is capable of being utilized in clip attachment machinery which incorporates various modifications of existing prior art machinery thereby enabling use of the clip of the invention with modified prior art clip attachment equipment. More specifically, the U-shaped clip members are fed through a clip channel about gathered packing material. The gathered material is positioned between the clip legs adjacent the crown of the clip. The clip is then driven downwardly against an anvil in a manner which plastically deforms the legs directing them in opposite directions through the through passage of the block or leg locking member. The leg locking member is thus fitted in the anvil at the end of the channel which feeds U-shaped plastic clips thereto. The locking member is positioned on or in the anvil intermediate the pathway of the spaced legs of the U-shaped clip member that is driven down the clip channel. The anvil includes a separate guide slot for receiving each of the clip legs and for directing the legs substantially simultaneously in opposite directions through the through passage of the leg locking member. The top of the leg locking member or sealing block is positioned opposite the crown of the clip member and is preferably shaped in a fashion which will accentuate the sealing characteristics of the closure construction. For example, the top surface of the leg locking member may be arcuate or convex. It may also be partially convex with a center recess or it may include serrations or other design features which will enhance the holding capability of the clip closure construction. Thus, the clip construction of the invention which is comprised of two elements can be easily incorporated with and used with prior art clip attachment mechanisms modified in a manner which will enable attachment of the disclosed clip construction about gathered packaging material.

As a further feature of the invention, the legs of the clip member or clip element may incorporate serrations which will enhance the ability of the legs to engage or interlock when fitted through the through passage of the block member or block element. The cross sectional pattern of the legs and clip element may also be varied along the length of the clip to enhance assembly of the clip element and block element or member. The crown of the clip element may include lugs or other features which enable the clip elements to be nested.

Thus, it is an object of the invention to provide an improved clip construction.

It is a further object of the invention to provide an improved clip construction which may be incorporated with modified clip attachment mechanisms of the type generally utilized for packaging purposes for U-shaped metal clips.

Yet another object of the invention is to provide a two-part clip construction wherein a U-shaped plastic polymeric clip member is cooperative with and can engage a leg locking member or sealing block member by deformation of the legs of the clip member in opposite directions through a passage or passages in the leg locking member.

Yet a further object of the invention is to provide a two-part clip construction which may be manufactured from polymeric materials as well as non-polymeric materials, but which preferably can be made from polymeric materials.

Another object of the invention is to provide a cost effective, easily applied clip construction capable of being placed around gathered packaging material and retaining that gathered packaging material by closing and sealing the gathered packaging material.

Another object of the invention is to provide a closure made from a material, such as a polymeric material, that may pass through x-ray detection equipment without detection. This allows the producer of such packages to test for foreign metallic objects other than the clip.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENTS

Figure 1:
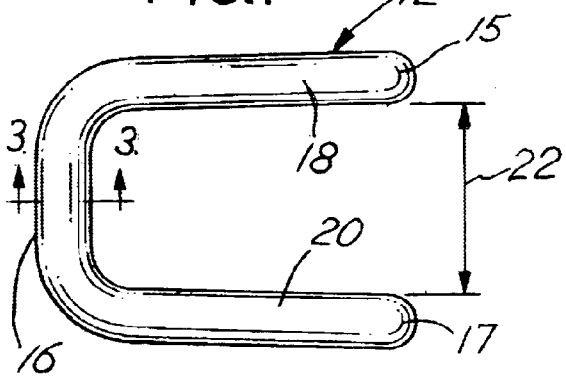
FIG. 1 is a plan view of the U-shaped first clip member of the clip construction.
Figure 3:
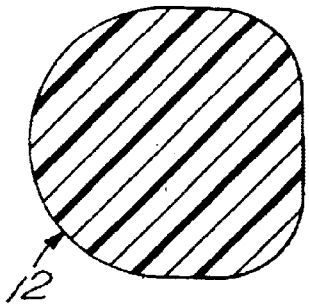
FIG. 3 is a cross sectional view of the first clip member of FIG. 1 taken along the line 3—3.
Figure 2:
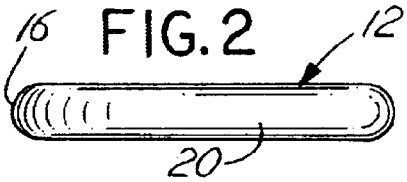
FIG. 2 is a side elevation of the clip of FIG. 1.
Figure 7:
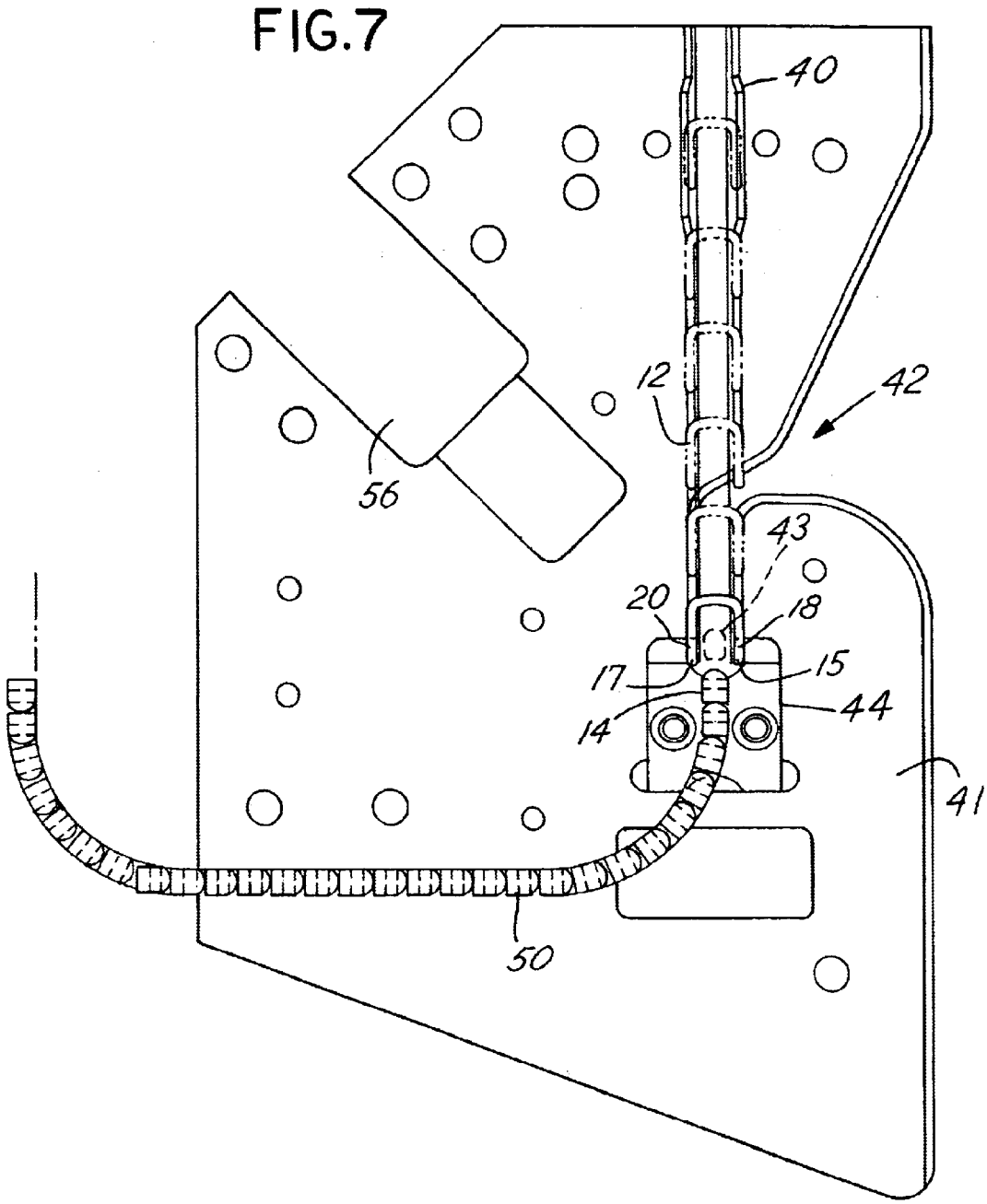
FIG. 7 is a side plan view of a clip attachment mechanism utilized for attachment of the clip of FIGS. 1–6 about gathered clip material.
Figure 8:
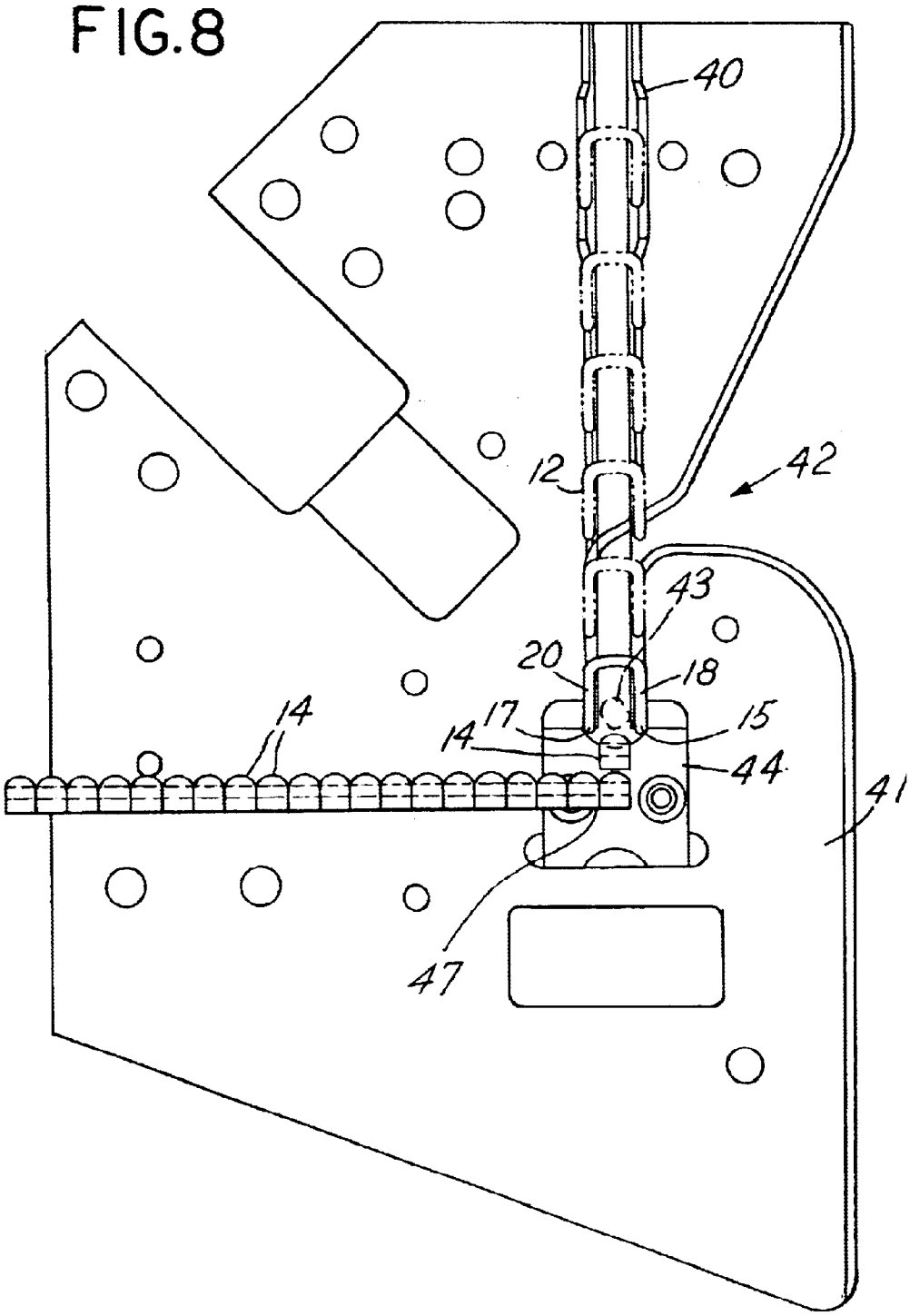
FIG. 8 is a side plan view of a clip attachment assembly that is an alterative construction to that depicted in FIG. 7.
Figure 9:
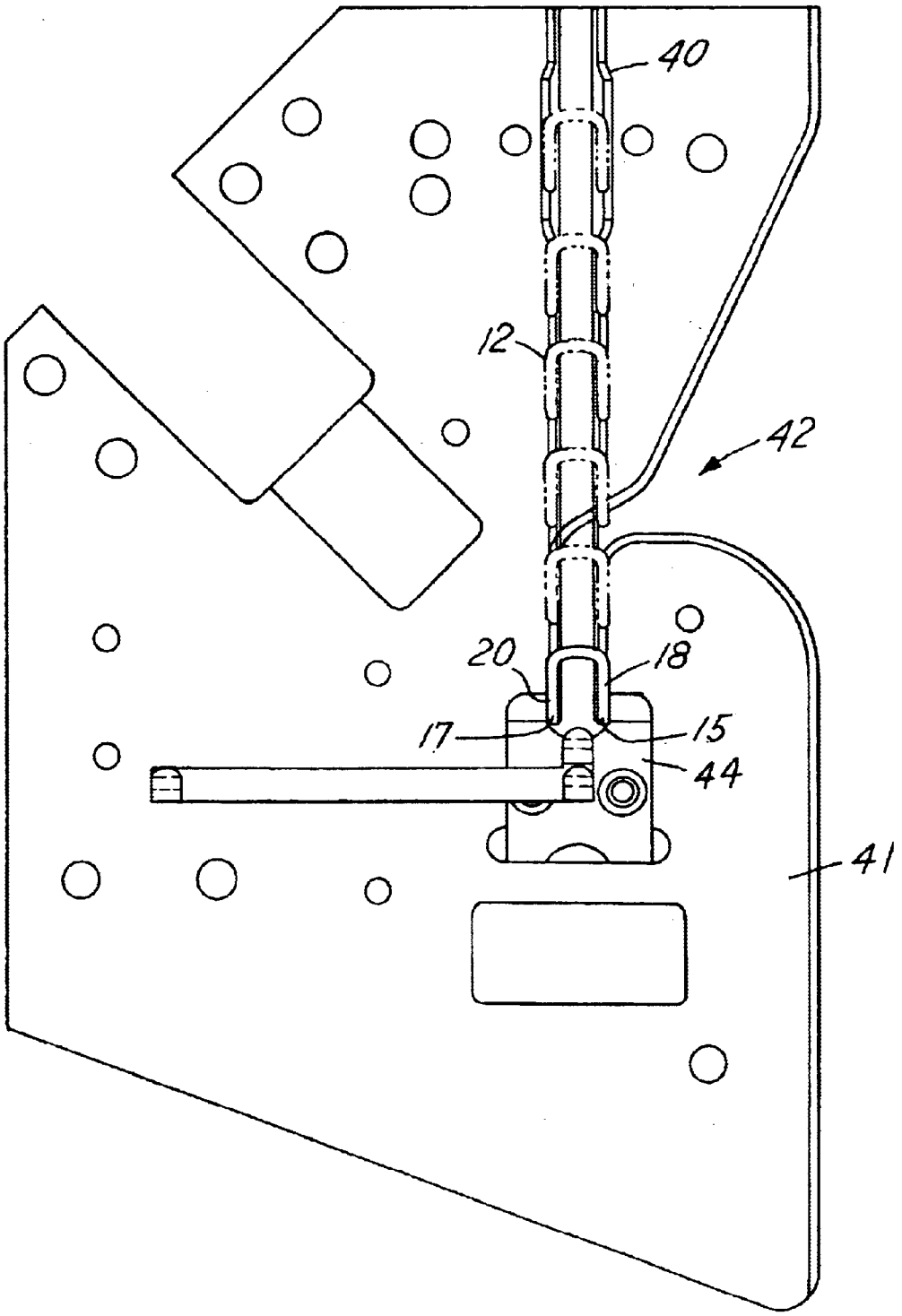
FIG. 9 is a side plan view of a third alternative embodiment for a clip attachment mechanism associated with or used with the clip construction of the invention.

FIGS. 1–6 illustrate a first embodiment of the clip construction which includes a first U-shaped clip member 12 and a second leg locking member lock or sealing block member 14. The first U-shaped clip member 12 includes a crown 16 connecting a first leg 18 to a generally parallel or slightly divergent second leg 20. Preferably, the cross section of the clip member 12 is uniform as depicted in FIG. 3 along the entire length of the clip. The legs 18 and 20 preferably are of equal length and coterminous. The legs 18 and 20 are spaced one from the other having an inside spaced dimension or distance 22. The clip member 12 is generally in the form of a staple though other configurations may be utilized. Preferably, the clip member 12 has a cross sectional configuration which is uniform along its entire length as shown in FIG. 3. However, the configuration or cross sectional shape of the legs 18 and 20, as well as the shape and configuration of the cross section of the crown 16, may be varied. In a preferred embodiment, the legs 18 and 20 are generally divergent from crown 16 outwardly very slightly and are designed to slide in a clip channel as depicted in FIGS. 7, 8 and 9 driven by a punch impinging against the outside or top side of crown 16.

Figure 4:
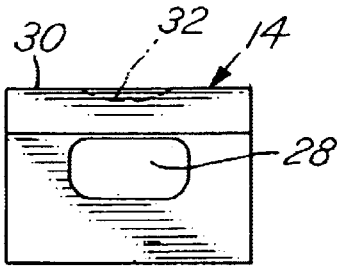
FIG. 4 is a side elevation of the leg locking member component, or element, of the two-part clip construction.
Figure 5:
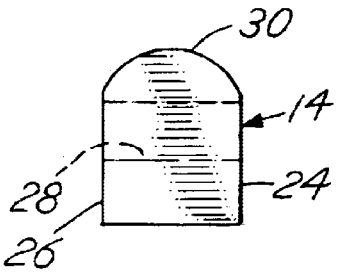
FIG. 5 is an end view of the leg locking member of FIG. 4.

The second part of the clip construction comprises the leg locking member 14. The leg locking member 14 includes, in a preferred embodiment, a first side 24 and a generally parallel, spaced, second side 26. A single through passage 28 is defined between the first and second sides 24 and 26. The through passage 28 is sized to simultaneously accommodate the legs 18 and 20 in side by side array as depicted in FIG. 4. The through passage 28 may therefore include guide sections or entry ramps associated with the through passage 28 so that the opposed legs 18, 20, as they bend, will be guided into the through passage 28.

In the preferred embodiment a single through passage 28 is provided to maintain the legs 18 and 20 in side by side, overlapping and constrained array as they are deformed and forced therethrough from opposite sides of through passage 28. However, separate through passages (not shown) may be provided for each of the legs 18, 20. Separate through passages will still maintain the legs 18, 20 in generally side by side though spaced array and the clip construction will still be configured to grip or maintain packaging material between the crown 16 and the block 14.

Preferably, the block 14 includes an arcuate, convex domed top surface 30. The top surface 30, when the clip member and leg locking member are joined, will be opposed to the underside of the crown 16. The top surface 30 may have other configurations and may, in fact, include, for example, an indentation such as depicted in phantom as indentations 32 in FIG. 4. The surface 30 may also include serrations, grooves, etc. When assembled, the configured top surface 30 tightly grips gathered packaging material and holds the packaging material in a manner that will prevent the clip construction from slipping from the gathered packaging material.

Figure 6A:
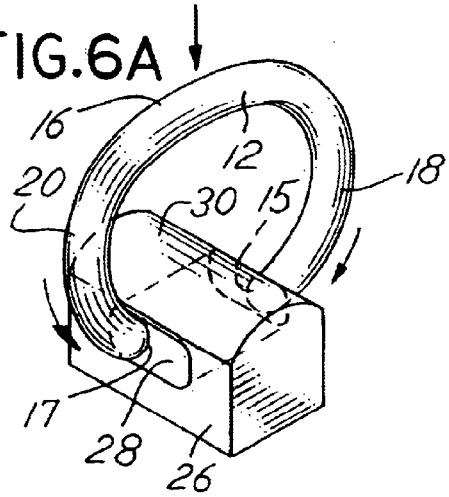
FIG. 6A is an isometric view of the two-part clip construction comprising the first U-shaped clip member and the separate leg locking member.
Figure 6B:
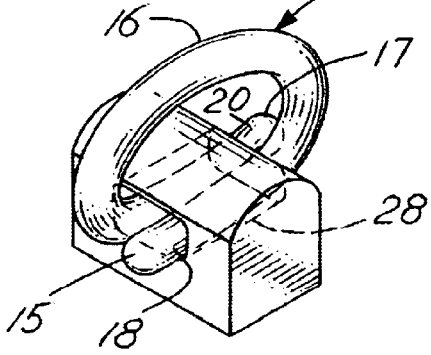
FIG. 6B is an isometric view of the clip construction of FIG. 6A wherein the parts are assembled.

FIGS. 6A and 6B illustrate the clip construction in two different configurations. In FIG. 6A the two separate members; namely, the first U-shaped clip member 12 is depicted positioned partially deformed and ready to be engaged with the through passage 28 by further deformation of legs 18, 20 from the opposite sides 24 and 26 of the block member 14. In Figure 6B the components parts, clip 12 and member 14, have been joined together in a manner, which will retain gathered packaging material.

FIGS. 7, 8 and 9 illustrate various methods and devices for joining the two parts of the clip construction; namely, the clip member 12 and the leg locking member 14. In a manner which is analogous to prior art clip attachment mechanisms such as referenced in the Background of the Invention. The clips 12 are fed singly into a vertical channel 40 and driven downwardly by a punch 41 about gathered material 43 that has been positioned through a neck opening 42 of a clip attachment machine or apparatus. The clip member 12 and more particularly, the legs 18 and 20, will then fit about the gathered material 43 carrying the gathered material downwardly in the channel 40. The ends 15 and 17 of the clip member 12 will then engage against arcuate slots or channels in an anvil 44 and be driven toward each other through the single through passage 28 of the block member 14 supported in anvil 44. The block member 14 is fed upwardly through a channel 50 in the anvil support 41. The block member 14 thus is positioned in a manner which will enable the legs 18 and 20 to be plastically deformed and fit through the through passage 28 about the gathered material. A knife cylinder 56 can then cut the packaging material 43 in a manner known by those skilled in the art and the component parts forming the package gathering mechanism will release the sealed package. The material, with the attached clip member 12 and block member 14, will then be removable from the clip attachment mechanism.

In FIG. 8 an alternate feed mechanism for the leg locking or block member 14 is depicted. The anvil 44 includes a side passage 47 rather than a lower end passage or channel 50 and the block member 14 is fed upwardly through the anvil 44 from the side passage 47 so as to expose the through passage 28 for engagement with the legs 18 and 20. FIG. 9 illustrates yet another configuration of such a feed mechanism. In all three mechanisms, the leg locking member 14 is fed through the anvil 44 upwardly to be positioned for the directed plastic deformation of the legs 18 and 20 by virtue of being driven against the anvil 44 and thereby deformed for movement through the through passage 28.

The particular configuration of the U-shaped clip member as well as the leg locking or block member 14 may be altered or varied. The material used to make these members may also be varied. For example, metal clips may be combined with polymeric materials. It is to be noted however, that the frictional engagement of the plastically deformed legs 18, 20 with the leg locking member 14 serve to form a sealed closure.

One of the important advantages of the invention is the fact that polymeric materials are preferred and may be utilized to practice the invention. Various manufacturing and health authorities have suggested that the use of polymerics may be desirable particularly, for the processing of food, for example. Additionally, there may be a cost benefit. Typical polymerics which may be utilized in the practice of the invention comprise the following: Ticona® nylon 66 1000 made by Celanese® and Zytel® 101L NC010 polymer made by DuPont®. These are known generically as Nylon 66 materials.

Figure 13:
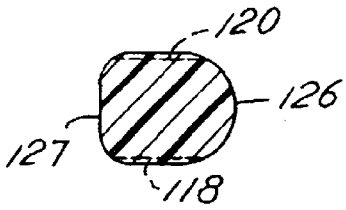
FIG. 13 is a cross sectional view of the leg of the clip member of FIG. 10 taken along the line 13—13.
Figure 14:
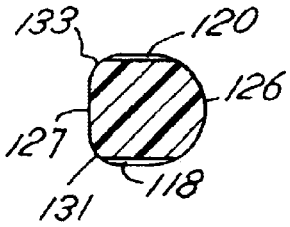
FIG. 14 is a cross sectional view of the leg of the clip member of FIG. 10 taken along the line of 14—14.
Figure 15:
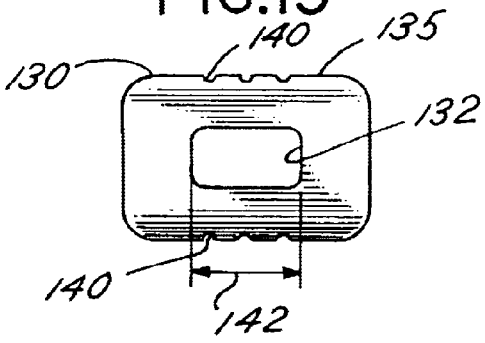
FIG. 15 is a side elevation view of a block member used in combination with the clip member of FIG. 10.
Figure 16:
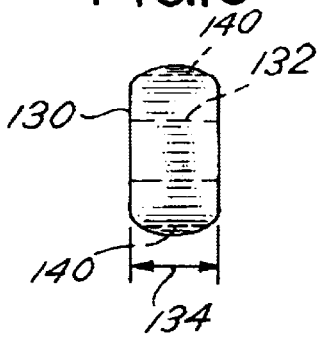
FIG. 16 is an end view of the block member of FIG. 15.

FIGS. 10–16 illustrate a second embodiment of a clip member 100 and body member 130 construction of the invention. FIGS. 10–14 illustrate the U-shaped clip element or member 100. FIGS. 15 and 16 illustrate the block member 130 of the alternative construction.

Referring to FIGS. 10–14, the U-shaped clip element or member 100 includes an arcuate crown 102, a first spaced leg 104 and a second spaced leg 106. In the embodiment depicted, the clip member 100 is made from a nylon 66 material as previously described. In a typical embodiment the crown 102 has an inside radius of 0.1 inches and an outside arcuate radius of 0.2 inches. The crown 102 includes a center nesting tab 108. The nesting tab 108 comprises a first transverse wing 110 and a second transverse wing 112 extending in opposite directions from the outside center of crown 102.

Figure 10:
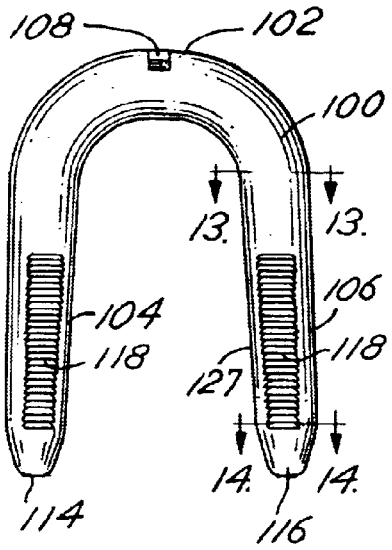
FIG. 10 is a front plan view of an alternate clip member construction.
Figure 11:
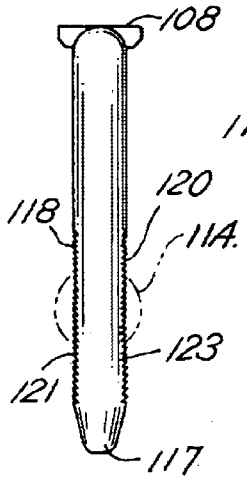
FIG. 11 is a side plan view of the clip member of FIG. 10.
Figure 11A:
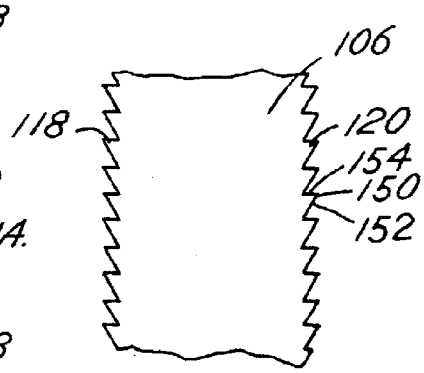
FIG. 11A is an enlarged particle plan view of the serrations of the clip member of FIG. 11.
Figure 12:
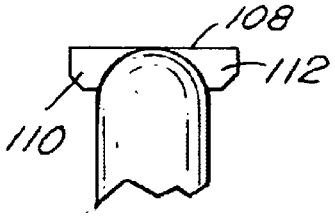
FIG. 12 is an enlarged detail of the crown of the clip member of FIG. 10.

Each of the legs 104 and 106 has a substantially identical configuration. The legs 104 and 106 diverge outwardly from the crown 102 as depicted in FIG. 10. Preferably legs 104 and 106 diverge outwardly in the range of 0° to 5°. The cross sectional configuration of the crown 102 and the upper end of the legs 104 and 106 is illustrated in FIG. 13. The lower end of the legs 104 and 106 has a cross sectional configuration depicted in FIG. 14 which is similar to the cross sectional configuration of FIG. 13. The distal ends 114 and 116 of the legs 104 and 106 are tapered to a blunt point 117. The lateral side faces 121, 123 of each of the legs 104, 106 include serrations 118 and 120, respectively. The serrations 118, 120 employ a specific shape or pattern in the preferred embodiment as depicted in FIG. 11A. That is, the serrations 118, 120 comprise ribs 150 with an inclined face 152 forming an acute angle with the longitudinal direction of leg 106 and a locking face 154 generally transverse to the longitudinal direction.

The cross sectional shape of the legs 104 and 106, as depicted in FIGS. 13 and 14, includes a flat inner side surface 127 connected by arcuate connecting surfaces 131 and 133 to the serrated sections 118 and 120. The outside face 126 of the clip legs 104 and 106 is arcuate in cross section. The thickness of the clip legs 104, 106 between the lateral sides 118, 120 of clip legs 104, 106 thus is less than the distance between the surfaces 127 and 126. For example, the dimension between the surfaces 127 and 126 maximum is 0.10 inches whereas the dimension between the side surfaces 118 and 120 is 0.081 inches thus providing a ratio of the dimensions of the distance between the inside to outside surface 127, 126 and the lateral serrated sides 118, 120 is in the range of 5 to 4.

FIGS. 15 and 16 illustrate block element 130. The block element 130 includes a through passage 132 and is generally rectangular in shape. The block element 130 further includes, as depicted in FIG. 16, a side to side dimension 134 which is less than the inside dimension of the space or separation of legs 104, 106. Notches 140 are provided in the outside surface 135 of the block element 130 to facilitate gripping or engagement with gathered material as discussed previously to prevent slippage of the attached clip from the gathered material.

To effect attachment, the legs 104 and 106 are deformed and directed to the through passage 132. As the legs 104 and 106 are deformed through the passage 132, the serrations 118 and 120 facilitate the interlocking engagement of the legs 104, 106 with one another. The lateral dimension of the opening 132; namely; the dimension 142 is approximately the same as the thickness of the legs as represented by the cross sectional view in FIG. 13. Thus, when the legs 104 and 106 are inserted through passage 132, the serrations 118 and 120 will be caused to engage with each other and the legs will be tightened in the opening 132 inasmuch as the legs 104, 106 have a tapered configuration. The tapering and the serrations 118, 120 thus improve the gripping interaction and the cooperative compression by virtue of the blocking or block element 130.

It is to be noted that the invention may be varied without departing from the spirit and scope thereof. The invention, therefore, is to be limited only by the following claims and equivalents thereof.

What is claimed is:

1. A two-part clip construction comprising, in combination:

a U-shaped first clip member having first and second spaced legs and a connecting crown, each of said legs having a leg end, said leg ends spaced a first distance, said first clip member being formed from a polymeric, plastically deformable material, whereby the first clip member may be strained to form a generally closed loop shape having the legs arranged in overlapping, side by side array; and a separate leg locking member for engaging and retaining the legs in overlapping side by side array, said locking member comprising a block with a through passage, said block having first and second generally parallel opposite sides with the through passage extending between the sides, said sides spaced a second distance no greater than the first distance, said through passage having a cross sectional configuration to accommodate and retain the legs in side by side strained array, said legs including serrations for engagement when deformed through the through passage.

2. The clip construction of claim 1 wherein the first clip member and locking member are comprised of polymeric material.

3. The clip construction of claim 1 wherein the first clip member comprises a rod having generally uniform cross section.

4. The clip construction of claim 3 wherein the cross section is a curved form.

5. The clip construction of claim 1 wherein the locking member through passage has a uniform cross section.

6. The clip construction of claim 1 wherein the through passage has a generally smooth surface.

7. The clip construction of claim 1 wherein the locking member includes an inner facing surface intermediate the opposite sides, said inner facing surface opposed to the crown of the first clip member when the first clip member and locking member are joined.

8. The clip construction of claim 7 wherein the inner facing surface is arcuate.

9. The clip construction of claim 7 wherein the inner facing surface includes at least one projection opposed to the crown of the first clip member.

10. The clip construction of claim 1 wherein the legs are strained to an overlapping and contacting condition.

11. The clip construction of claim 1 wherein the through passage comprises a single passage.

12. The construction of claim 1 wherein the leg ends are generally coterminous.

13. The clip construction of claim 1 wherein the through passage is generally rectangular.

14. The clip construction of claim 1 wherein the legs are tapered.

15. The clip construction of claim 1 including an outside face in the block member with slots in the outside face.

16. The clip construction of claim 1 wherein the crown includes an arcuate crown.

17. The clip construction of claim 16 wherein the crown includes an outside face with a nesting tab.

18. A two-part clip construction comprising, in combination:

a U-shaped first clip member having first and second spaced legs and a connecting crown, each of said legs having a leg end, said leg ends spaced a first distance, said first clip member being formed from a polymeric plastically deformable material, whereby the first clip member may be strained to form a generally closed loop shape having the legs arranged in overlapping, side by side array; and a separate leg locking member for engaging and retaining the legs in overlapping side by side array, said locking member comprising a block with a through passage, said block having first and second generally parallel opposite sides with the through passage extending between the sides, said sides spaced a second distance no greater than the first distance, said through passage having a cross sectional configuration to accommodate and retain the legs in side by side strained array, said locking member further including an arcuate innerfacing surface intermediate the opposite sides, said innerfacing surface opposed to the crown of the first clip member when the clip member and locking member are joined.

19. The clip construction of claim 18 including an outside face in the block member with slots in the outside face.

20. The clip construction of claim 18 wherein the first clip member and locking member are comprised of polymeric material.

21. The clip construction of claim 18 wherein the first clip member comprises a rod having generally uniform cross section.

22. The clip construction of claim 21 wherein the cross section is a curved form.

23. The clip construction of claim 18 wherein the locking member through passage has a uniform cross section.

24. The clip construction of claim 18 wherein the first clip member has a generally smooth surface and the through passage has a generally smooth surface.

25. The clip construction of claim 18 wherein the inner facing surface includes at least one projection opposed to the crown of the first clip member.

26. The clip construction of claim 18 wherein the legs are strained to an overlapping and contacting condition.

27. The clip construction of claim 18 wherein the through passage comprises a single passage.

28. The construction of claim 18 wherein the leg ends are generally coterminous.

29. The clip construction of claim 18 wherein the through passage is generally rectangular.

30. The clip construction of claim 18 wherein the legs are tapered.

31. The clip construction of claim 18 wherein the legs include serrations for engagement when deformed through the through passage.

32. The clip construction of claim 18 wherein the crown includes an arcuate crown.

33. The clip construction of claim 18 wherein the crown includes an outside face with a nesting tab.

34. A two-part clip construction comprising, in combination:

a U-shaped first clip member having first and second spaced legs and a connecting crown, said crown including an outside face with a nesting tab, each of said legs having a leg end, said leg ends spaced a first distance, said first clip member being formed from a polymeric plastically deformable material, whereby the first clip member may be strained to form a generally closed loop shape having the legs arranged in overlapping, side by side array; and a separate leg locking member for engaging and retaining the legs in overlapping side by side array, said locking member comprising a block with a through passage, said block having first and second generally parallel opposite sides with the through passage extending between the sides, said sides spaced a second distance no greater than the first distance, said through passage having a cross sectional configuration to accommodate and retain the legs in side by side strained array.

35. The clip construction of claim 34 including an outside face in the block member with slots in the outside face.

36. The clip construction of claim 34 wherein the first clip member and locking member are comprised of polymeric material.

37. The clip construction of claim 34 wherein the first clip member comprises a rod having generally uniform cross section.

38. The clip construction of claim 37 wherein the cross section is a curved form.

39. The clip construction of claim 34 wherein the locking member through passage has a uniform cross section.

40. The clip construction of claim 34 wherein the first clip member has a generally smooth surface and the through passage has a generally smooth surface.

41. The clip construction of claim 34 wherein the locking member includes an inner facing surface intermediate the opposite sides, said inner facing surface opposed to the crown of the first clip member when the first clip member and locking member are joined.

42. The clip construction of claim 41 wherein the inner facing surface is arcuate.

43. The clip construction of claim 41 wherein the inner facing surface includes at least one projection opposed to the crown of the first clip member.

44. The clip construction of chum 34 wherein the legs are strained to an overlapping and contacting condition.

45. The clip construction of claim 34 wherein the through passage comprises a single passage.

46. The construction of claim 34 wherein the leg ends are generally coterminous.

47. The clip construction of claim 34 wherein the through passage is generally rectangular.

48. The clip construction of claim 34 wherein the legs are tapered.

49. The clip construction of claim 34 wherein the legs include serrations for engagement when deformed through the through passage.

50. The clip construction of claim 34 wherein the crown includes an arcuate crown.

51. A two-part clip construction comprising, in combination:

a U-shaped first clip member having first and second spaced legs and a connecting crown, each of said legs having a leg end, said leg ends spaced a first distance, said first clip member being formed in said U-shape from a polymeric, plastically deformable material, whereby the first clip member may be strained from said U-shape to form a generally closed loop shape having the legs arranged in overlapping, side by side array; and a separate leg locking member for engaging and retaining the legs in overlapping, side by side array, said locking member comprising a block with a through passage, said block having first and second opposite sides with the through passage extending between the opposite sides, said opposite sides spaced a second distance no greater than the first distance, said through passage having a cross sectional configuration to accommodate and retain the legs in side by side strained array when said first and second legs are strained to engage the through passage respectively from the first and second sides of the block.

52. The clip construction of claim 51 including an outside face in the block member with slots in the outside face.

53. The clip construction of claim 51 wherein the first clip member and locking member are comprised of polymeric material.

54. The clip construction of claim 51 wherein the first clip member comprises a rod having generally uniform cross section.

55. The clip construction of claim 54 wherein the cross section is a curved form.

56. The clip construction of claim 51 wherein the locking member through passage has a uniform cross section.

57. The clip construction of claim 51 wherein the first clip member has a generally smooth surface and the through passage has a generally smooth surface.

58. The clip construction of claim 51 wherein the locking member includes an inner facing surface intermediate the opposite sides, said inner facing surface opposed to the crown of the first clip member when the first clip member and locking member are joined.

59. The clip construction of claim 58 wherein the inner facing surface is arcuate.

60. The clip construction of claim 51 wherein the inner facing surface includes at least one projection opposed to the crown of the first clip member.

61. The clip construction of claim 51 wherein the legs are strained to an overlapping and contacting condition.

62. The clip construction of claim 51 wherein the through passage comprises a single passage.

63. The construction of claim 51 wherein the leg ends are generally coterminous.

64. The clip construction of claim 51 wherein the through passage is generally rectangular.

65. The clip construction of claim 51 wherein the legs are tapered.

66. The clip construction of claim 51 wherein the legs include serrations for engagement when deformed through the through passage.

67. The clip construction of claim 51 wherein the crown includes an arcuate crown.

68. The clip construction of claim 51 wherein the crown includes an outside face with a nesting tab.

* * * * *